United States Patent [19]

Bowman

[11] Patent Number: 4,476,470

[45] Date of Patent: Oct. 9, 1984

[54] THREE HORN E-PLANE MONOPULSE FEED

[75] Inventor: David F. Bowman, Moorestown, N.J.

[73] Assignee: RCA Corporation, New York, N.Y.

[21] Appl. No.: 421,518

[22] Filed: Sep. 22, 1982

[51] Int. Cl.[3] ..... H01Q 25/02; H01Q 25/04

[52] U.S. Cl. ..... 343/778; 343/786

[58] Field of Search ..... 343/16 M, 776, 777, 343/778, 786

[56] References Cited

U.S. PATENT DOCUMENTS

| | | | |
|---|---|---|---|
| 3,037,204 | 5/1962 | Allen et al. | 343/100 R |
| 3,883,877 | 5/1975 | Chabah et al. | 343/778 |
| 4,090,203 | 5/1978 | Duncan | 343/753 |
| 4,096,482 | 6/1978 | Walters | 343/778 |

OTHER PUBLICATIONS

"Optimum Feeds for All Three Modes of a Monopulse Antenna I: Theory" pp. 444–454 by Peter W. Hannan, *IRE Transactions on Antennas and Propagation,* Sep. 1961.

"Optimum Feeds for All Three Modes of a Monopulse Antenna II: Practice" pp. 454–461 by Peter W. Hannan, *IRE Transactions on Antennas and Propagation,* Sep. 1961.

*Primary Examiner*—Eli Lieberman

*Attorney, Agent, or Firm*—Joseph S. Tripoli; Robert L. Troike; Robert Ochis

[57] ABSTRACT

A three-horn microwave feed produces a near ideal aperture width ratio of 2:1 for the difference and sum modes of aperture illumination. Three horns are utilized, each of which supports propagation of at least two modes. Sum and difference components are present in all three horns in response to signals applied to both sum and difference ports of the feed and sum illumination components are present in all three horns in response to signals applied to only the sum port of the feed.

10 Claims, 13 Drawing Figures

Figure 1:
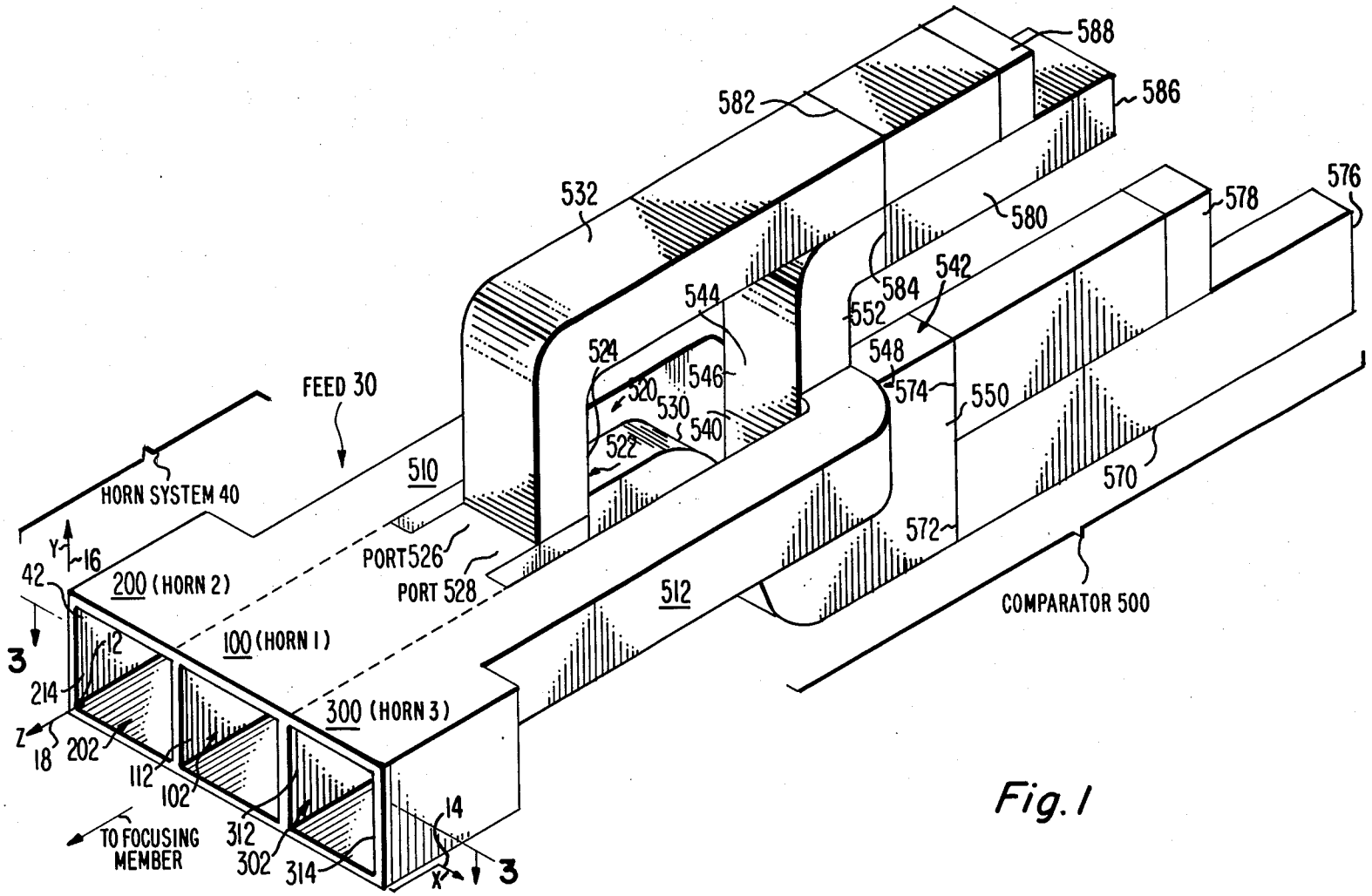

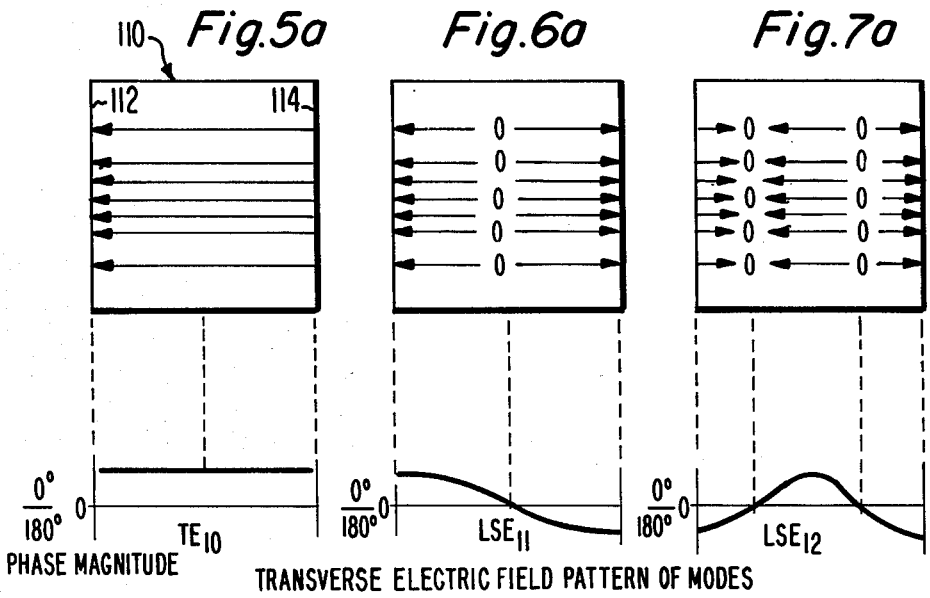
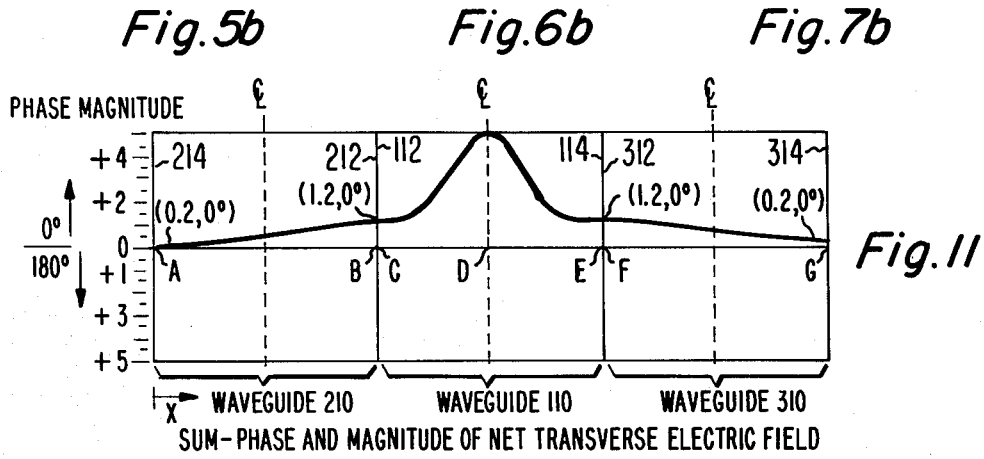
Fig.11
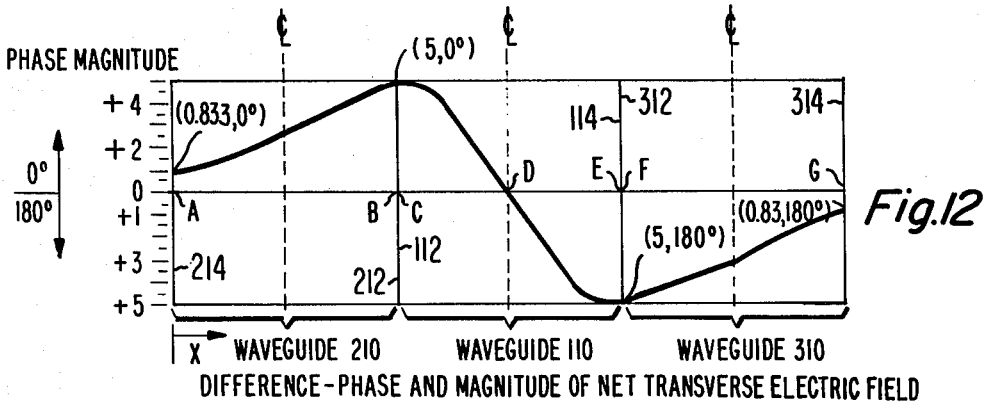
Fig.12

THREE HORN E-PLANE MONOPULSE FEED

This invention relates to the field of microwave antennas and more particularly to the field of monopulse feeds for such antennas.

It is known that the ideal feed aperture width for the illumination of a reflector antenna is different for sum and difference illuminations. The aperture width of the feed for difference illuminations should be larger by a factor of about two than the ideal width of the feed aperture for sum illumination. See for instance "Optimum Feeds for All Three Modes of a Monopulse Antenna I: Theory" pp 444—454 and "Optimum Feeds for All Three Modes of a Monopulse Antenna II: Practice" pp 454–461 by Peter W. Hannan, *IRE Transactions on Antennas and Propagation,* September 1961.

This aperture width ratio has been approximated in the prior art for an E-plane feed by a single horn which supports propagation in multiple modes and by a plurality of horns each supporting propagation in a single mode. These prior art systems are complicated, provide only a rough approximation to the ideal illumination and are restricted to proper operation over fairly narrow bandwidths.

A feed system is needed which can achieve a 2:1 difference in aperture width for difference and sum signals in a wide band manner without itself being unduly complex.

In accordance with a preferred embodiment of the present invention a microwave monopulse feed system comprises three substantially rectangular horns each dimensioned for supporting the fundamental transverse electric mode and a higher order anti-symmetric mode over an operating range of frequencies. The feed includes means to excite these modes. The radiation apertures of the three horns form a composite feed radiation aperture. The ratio of the effective aperture widths for monopulse sum and difference illumination in this feed is controlled by the comparator which transmits signals between its sum port and the horns and between its difference port and the horns. Proper selection of coupling ratios in this comparator provides an effective sum aperture to effective difference aperture ratio of 1:2. The arrangement also provides signal illuminations which are continuous across the composite aperture. The horns are preferably disposed in a single row with a central horn which propagates $TE_{10}$, $LSE_{11}$ and $LSE_{12}$ modes and outer horns, which propagate $TE_{10}$ and $LSE_{11}$ modes.

In the Drawings

Figure 4:
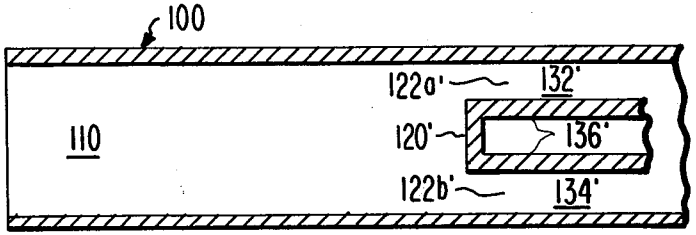
Figure 2:
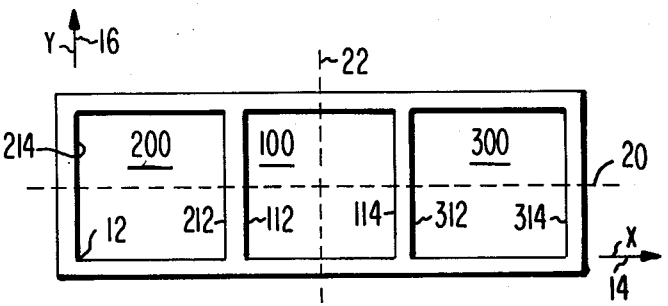
Figure 3:
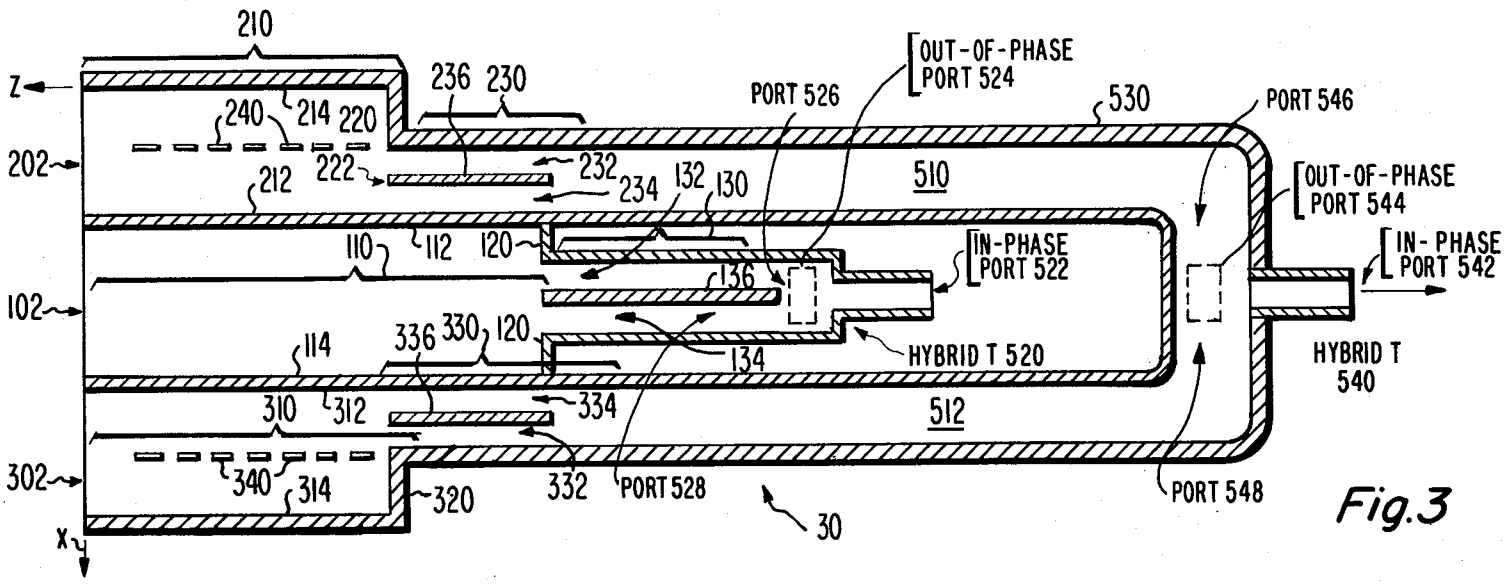
Figure 8:
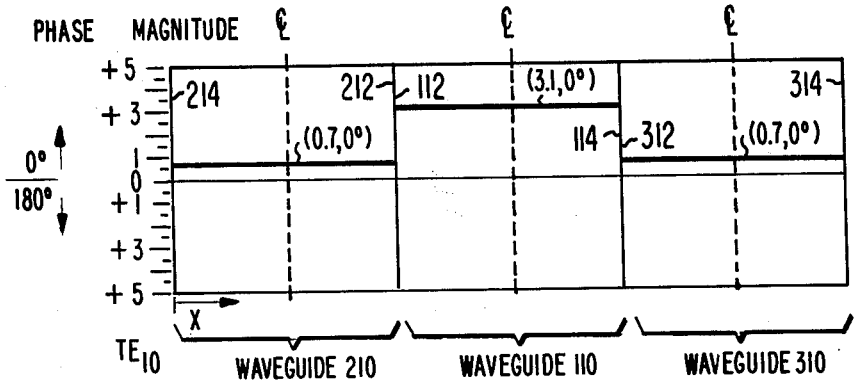
Figure 9:
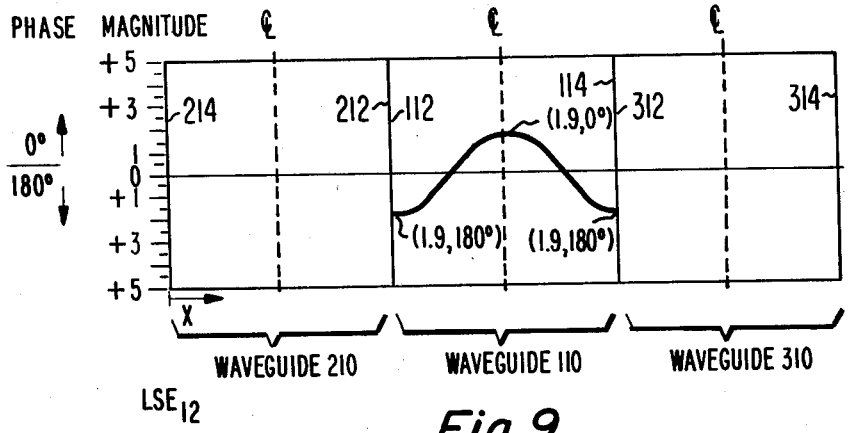
Figure 10:
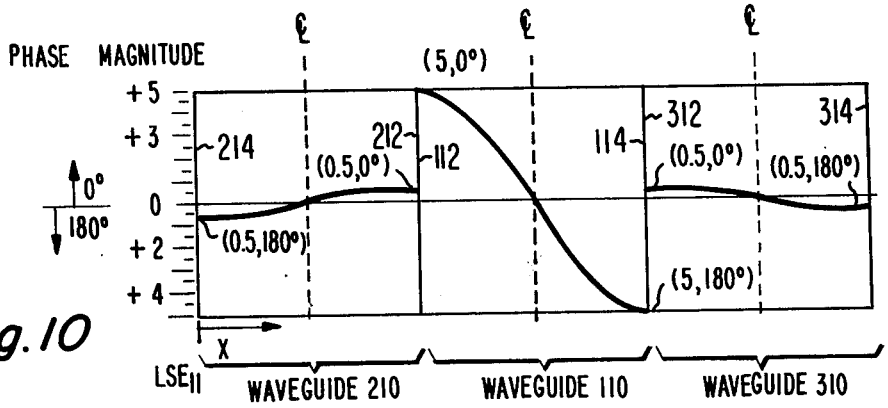
Figure 13:
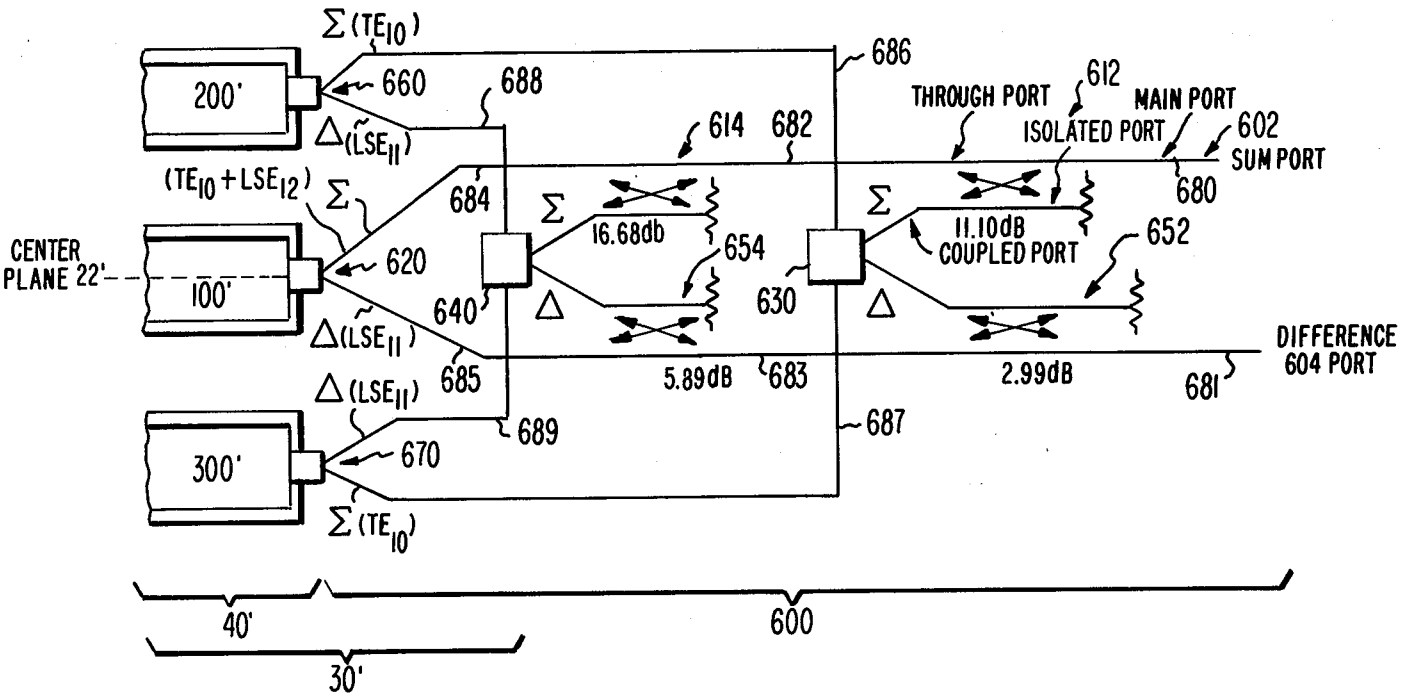

FIG. 1 is a perspective-like view of a three horn feed in accordance with the present invention, FIG. 2 is an end view of the feed of FIG. 1 viewed from the direction of a focusing member, FIG. 3 is a partial cross-section view of the internal configuration of the feed of FIG. 1 taken along the line 3—3, FIG. 4 is a cross-section view of an alternative structure for the center horn of the feed of FIG. 1, FIGS. 5*a*, 6*a* and 7*a*, are illustrations of the transverse electric field patterns of modes which propagate in the feed of FIG. 1, FIGS. 5*b*, 6*b* and 7*b*, are graphs of the phase and magnitude of the transverse electric field of the modes of FIGS. 5*a*, 6*a* and 7*a*, as a function of lateral position in the waveguide, FIGS. 8, 9 and 10, are graphs which illustrate the phase and magnitude of the transverse electric field of each of the propagated modes as a function of lateral position within the horns of the feed, FIGS. 11 and 12 are graphs which illustrate the net transverse electric field magnitude and phase as a function of lateral position at the radiating aperture for excitation of the feed with signals at the sum and difference ports, respectively, and FIG. 13 is a schematic illustration of an alternative feed having a different comparator circuit.

A schematically simplified monopulse feed system for a microwave antenna having a focusing member is illustrated generally at 30 in FIG. 1 (in perspective) in FIG. 2 (end-on) and in FIG. 3 (in a partial cross-section view of its internal structure). The feed system 30 comprises a horn system 40 and a comparator 500 to which the horn system 40 is connected. Horn system 40 comprises three rectangular horns—a central horn 100 and two outer horns 200 and 300, positioned adjacent opposing sides of the central horn 100, to form a composite rectangular aperture 42. An x-y-z coordinate system 10 has its origin 12 at the lower left hand corner of the aperture 42. The x-axis 14 and the y-axis 16 are along perpendicular edges of aperture 42 and define the plane of the aperture 42. The z-axis is perpendicular to the plane of the aperture and extends away from the feed 30. Each of the horns has a substantially rectangular cross section and is configured to excite and propagate a plurality of modes. The horns are positioned with their planes of (E-field) polarization parallel to the x-axis 14 (horizontal in the FIGURES). These horns are positioned in a row in a manner to align the E-fields of their fundamental modes collinearly. The center plane 20 (FIG. 2) of the central horn (which is also a plane of polarization) is preferably a plane of symmetry for the horn system. The horn system 40 is also preferably symmetric about plane 22 (FIG. 2) of the central horn 100 which is perpendicular to center plane 20 (and also to the plane of the aperture 42). The E-plane for this feed (any xz plane in FIG. 1) is parallel to the center plane 20. The H-plane for this feed (any yz plane in FIG. 1) is parallel to the perpendicular center plane 22.

A monopulse sum signal for feed 30 is one which is in phase across the entire composite aperture 42 and whose amplitude is symmetric about the center plane 22 of horn 100. Such a sum signal is referred to as being symmetric or having even symmetry and may be referred to as sum illumination of the composite aperture 42.

A monopulse difference signal is one which at the composite aperture 42 is in phase with the sum signal on one side of center plane 22 and is 180° out of phase with the sum signal on the other side of center plane 22. The amplitude of a difference signal is symmetrical about the center plane 22 and is generally zero at the center plane 22. Because the portions of the difference signal on different sides of plane 22 are 180° out of phase, this signal is often referred to as being anti-symmetric or having odd symmetry. This difference signal may also be referred to as difference illumination of the composite aperture 42.

The comparator 500 comprises: (1) a sum directional coupler 570 (not shown in FIG. 3) for separating an input sum signal (accepted at a sum port 576) into a central horn sum signal and an outer horns sum signal; (2) a difference directional coupler 580 (not shown in FIG. 3) for separating a difference input signal (accepted at a difference port 586) into a central horn difference signal and an outer horns difference signal; (3) a hybrid tee 520 connected to receive the central horn sum and difference signals from directional couplers 570 and 580, respectively, and to couple those signals to two waveguides, 132 and 134, (FIG. 3) of central horn 100 to transmit those sum and difference signals to central horn 100; and (4) a hybrid tee 540 connected to receive the outer horns sum and difference signals from directional couplers 570 and 580, respectively, and to couple those signals to the outer horns 200 and 300.

The sum directional coupler 570 has a coupling ratio of 10.12 dB and provides most of the sum signal power to the central horn 100. The difference directional coupler has a coupling ratio of 4.33 dB and provides most of the difference power to the outer horns hybrid tee 540. These coupling ratios provide the signal levels illustrated in FIGS. 11 and 12 which are discussed subsequently. On reception, this signal transmission is reversed and because each of the system components is designed to operate in a reciprocal fashion during reception, the sum received signal emerges from sum port 576 and the difference received signal emerges from difference port 586.

During transmission, the signal to be transmitted is preferably applied to only the sum port 576 of comparator 500 which delivers appropriate signals to the horn system 40 for transmission to a focussing member (not shown). During reception the comparator accepts received signals from horn system 40 and provides a sum received signal at sum port 576 and a difference received signal at difference port 586. These sum and difference signals are appropriate for monopulse processing to determine the angular position of a source of the received signal relative to the horn system 40 in a direction parallel to center plane 20 and thus parallel to the E-plane of the horn system 40.

Feed system 30 preferably illuminates a focussing member (not shown) which may comprise any appropriate focussing object such as a reflector, a lens, a transmission array, a reflect array and so forth.

Signals are propagated in horn system 40 of this preferred embodiment in three different waveguide modes. These modes are the $TE_{10}$, $LSE_{11}$ and $LSE_{12}$ modes. TE stands for transverse electric field, meaning with the electric field perpendicular to the direction of propagation. LSE stands for longitudinal section electric field. In an LSE mode in a rectangular waveguide all of the electric field (E-field) lines lie in longitudinal planes of the waveguide that are parallel to one pair of the waveguide's walls. In the LSE modes utilized in this preferred embodiment all of the electric field lines are in planes parallel to the planes of polarization. This may be referred to as a parallel LSE mode.

An $LSE_{11}$ parallel mode has a half-cycle distribution of transverse electric field amplitude in the E-plane within the waveguide and a half-cycle distribution in the H-plane. An $LSE_{12}$ parallel mode has a one-cycle distribution in the E-plane and a half-cycle distribution in the H-plane.

The transverse E-field pattern and magnitude distribution in a transverse cross section for the $TE_{10}$, $LSE_{11}$ nd $LSE_{12}$ modes are illustrated in FIGS. 5, 6, and 7, respectively. In the field patterns (FIGS. 5*a*, 6*a*, and 7*a*) an arrow pointing to the left indicates 0° phase, an arrow point to the right indicates 180° phase and a "0" indicates a null where the transverse amplitude is always zero. This relationship is further emphasized by the magnitude/phase graphs of FIGS. 5*b*, 6*b* and 7*b* which appear directly below and are aligned with FIGS. 5*a*, 6*a* and 7*a*.

Hereinafter in this specification references to LSE modes are to the LSE parallel modes used in this preferred embodiment.

In general, a hybrid junction or tee has four ports, two collinear ports, an E-plane port and an H-plane port. The E-plane port and the H-plane port each couple only to the collinear ports. There are a number of hybrid tee configurations including those known as magic tees, E-plane folded tees and H-plane folded tees. In each of these configurations either the E-plane port or the H-plane port couples to the collinear ports in-phase and the other of the E-plane and H-plane ports couples to the collinear ports out-of-phase. The collinear ports are referred to as collinear ports even in those configurations such as E-plane folded tees and H-plane folded tees in which they are not physically collinear. Since the important characteristic of a hybrid tee's E-plane and H-plane ports in the comparator of this preferred embodiment is the phase of their coupling to the collinear ports of the tee rather than whether they are E-plane or H-plane ports, those ports will often be referred to hereinafter by the phase of their coupling to the collinear ports, i.e. as an in-phase port and an out-of-phase port. The in-phase port may also be referred to as a sum port or as a symmetric port and the out-of-phase port may be referred to as a difference port or as an anti-symmetric port.

The central horn 100 has an input (on transmission) waveguide 130 which preferably is rectangular in cross-section and has a centrally located H-plane-extending vane 136 which extends the full height of the waveguide 130. Vane 136 divides waveguide 130 into two separate, preferably equally dimensioned sub-waveguides 132 and 134. Each of the waveguides 132 and 134 is dimensioned to propagate only the $TE_{10}$ mode. The input ends of waveguides 132 and 134 terminate in the comparator's E-plane folded tee 520 which has an E-plane (sum) port 522 and an H-plane (difference) port 524 for the extraction of separate sum and difference signals respectively on reception in order to provide the ability to perform monopulse processing.

The end of the waveguide 130 which is remote from the folded tee 520 connects to the input (on transmission) end of a second rectangular waveguide 110. Waveguide 110 is preferably larger than waveguide 130 and is dimensioned to support the propagation in a designed operating frequency band of the $TE_{10}$, $LSE_{11}$ and $LSE_{12}$ modes. Waveguide 110 has lateral walls 112 and 114 (FIG. 3) and a conducting wall 120 closing the input end thereof. Wall 120 has a rectangular aperture 122 therein which is centrally located in the x-direction and which extends the full height of the waveguide 110 in the y-direction. Aperture 122 extends only part way across the waveguide 110 in the x-direction. The waveguide 130 connects to the waveguide 110 at the wall 120 via aperture 122. Waveguide 110 has a radiating aperture 102 at the end which is remote from wall 120. Aperture 102 constitutes the central portion (laterally) of composite aperture 42 of the feed system.

The central location of aperture 122 and its physical dimensions within waveguide 110 causes $TE_{10}$ mode signals propagating in-phase (with their electric fields parallel) in waveguides 132 and 134 to partially convert to an $LSE_{12}$ mode in waveguide 110. The remaining portion of the energy in the in-phase $TE_{10}$ modes in waveguides 132 and 134 propagates as a $TE_{10}$ mode in waveguide 110. Both the $TE_{10}$ and $LSE_{12}$ modes are symmetrical and thus are excited by the symmetrical location of the aperture 122 for in-phase waves $TE_{10}$ in waveguides 132 and 134. For the step illustrated in horn 100 the $TE_{10}$ and the $LSE_{12}$ modes are in-phase at the perpendicular center plane 22. If the waveguides 132 and 134 instead emerged along opposing lateral walls of waveguide 110 as illustrated in FIG. 4 where the end wall 120' is centrally located (x-direction) with apertures 122a' and 122b' at the ends of waveguides 132' and 134' defined by "vane" 136' then the $LSE_{12}$ and $TE_{10}$ modes would be 180° out of phase at the perpendicular center plane 22.

$TE_{10}$ modes propagated 180° out-of-phase (with their electric field vectors anti-parallel) in waveguides 132 and 134 are converted to an $LSE_{11}$ mode in waveguide 110 at aperture 122. The $LSE_{11}$ mode is anti-symmetrical and is excited as a result of the anti-symmetric excitation of the symmetrical aperture 122.

The two outer horns 200 and 300 differ from central horn 100, but are similar to each other except for orientation. The horn 300 is rotated 180° relative to horn 200 so that horn system 40 will be symmetric about center plane 22. The horn 200 will be described in detail. Corresponding structures in the horn 300 have reference numerals which correspond to those for the horn 200, but are in the 300's rather than in the 200's.

The horn 200 has an input waveguide 230, (on transmission), which is preferably rectangular and which connects to one of the collinear ports of the comparator's hybrid tee 540. The waveguide 230 is preferably dimensioned to support only the propagation of the $TE_{10}$ mode. The $LSE_{11}$ wave is not wanted in waveguide 230. Therefore, if waveguide 230 will support this mode, a centrally disposed vane 236 is added to waveguide 230. Vane 236 extends the full height of the waveguide 230 in the y-direction and thus forms two sub-waveguides 232 and 234 which are cut off to the $LSE_{11}$, the $TE_{11}$ and the $TM_{11}$ modes. The vane 236 does not modify substantially the field configuration of the $TE_{10}$ mode. If the dimensions of waveguide 230 are such that those cut off modes are cut off in any event, the vane 236 may be omitted. The end of waveguide 230 which is remote from the hybrid tee 540 connects to the input (on transmission) end of a rectangular waveguide 210. Waveguide 210 is dimensioned to support the propagation of the $TE_{10}$ and the $LSE_{11}$ modes within the designed operating frequency band of the feed 30 and thus is larger than waveguide 230. Waveguide 210 has lateral walls 212 and 214 and a conducting wall 220 closing its input end except for an aperture 222 therein which is off center with respect to the lateral walls 212 and 214. Aperture 222 preferably extends the full height of the waveguide 210 in the y-direction and extends from a first lateral wall 212 of the waveguide 210 to the center line of the waveguide 210 in the x-direction. Waveguide 210 has a radiating aperture 202 at its end which is remote from the conducting wall 220. Radiating aperture 202 constitutes a portion of the composite aperture 42 of the feed system.

Because of the off-center nature of the aperture 222 in wall 220 of waveguide 210, the $TE_{10}$ mode propagating in waveguide 230 upon reaching the aperture 222 is partially converted to an $LSE_{11}$ mode in the waveguide 210. The remaining portion of the energy in the $TE_{10}$ mode in waveguide 230 propagates in waveguide 210 as a $TE_{10}$ mode as a result of the incomplete conversion of the $TE_{10}$ mode to the $LSE_{11}$ mode. Although the dimensions of the waveguide 210 may be large enough to support the propagation of the $LSE_{12}$ mode at the designed operating frequencies, the off-center position of the aperture 222 results in little, if any, conversion of energy to the $LSE_{12}$ mode because of the symmetry of that mode.

In the outer horns 200 and 300, the partial conversion of the $TE_{10}$ wave propagating in the input waveguides 230 and 330 into the $LSE_{11}$ wave propagating in waveguides 210 and 310, respectively, results in the $LSE_{11}$ wave in the larger waveguides being initially in phase with the $TE_{10}$ wave. To obtain the desired illumination function, the $LSE_{11}$ and the $TE_{10}$ waves should be propagating in-phase at the radiating aperture 42 of the feed system 30. The step configuration of wall 220 and the aperture 222 as shown (and the corresponding configuration in horn 300) excites the $LSE_{11}$ mode with respect to the $TE_{10}$ mode in the phase that is desired at the aperture 222. However the $LSE_{11}$ mode has a higher phase velocity in the air dielectric guide 210 (310) than does the $TE_{10}$ mode. Waveguide 210 preferably incorporates a plurality of thin vanes 240 extending the full height of the waveguide 210 in the y-direction and disposed along the center line of the waveguide 210 with their major faces parallel to the H-plane. Being thin and having their major faces everywhere perpendicular to the $TE_{10}$ electric field, the vanes do not affect the $TE_{10}$ field distribution or its velocity. The major faces of the vanes are parallel to the axial electric field of the $LSE_{11}$ mode. This results in a capacitive loading effect which reduces the phase velocity of the $LSE_{11}$ mode. Thus, the vanes 240 serve to slow the propagation velocity of the $LSE_{11}$ wave to maintain it in-phase with the $TE_{10}$ wave at the radiating aperture 202. These vanes are effective for this purpose over a wide frequency range and therefore contribute to this feed being effective over a wide range of frequencies.

In comparator 500, the central horn hybrid tee 520 is preferably an E-plane folded hybrid tee having an E-plane in-phase (symmetric) port 522 and an H-plane out-of-phase (anti-symmetric) port 524 and collinear ports 526 and 528 as illustrated in FIG. 1. The "collinear" ports 526 and 528 of central horn hybrid tee 520 may be connected directly to the sub-waveguides 132 and 134, respectively, of the central horn or may be remotely positioned with additional waveguides coupling these sub-waveguides to the hybrid tee.

The outer horns hybrid tee 540 is preferably a magic tee having an in-phase (symmetrical) port 542 and an out-of-phase (anti-symmetrical) port 544 and collinear ports 546 and 548. The outer-horns hybrid tee 540 may have its collinear ports 546 and 548 coupled directly to the outer horn waveguides 230 and 330, respectively, or may be positioned remotely therefrom and connected by waveguides such as 510 and 512 as illustrated in FIG. 1. The waveguides 510 and 512 are symmetrical and of equal phase length in order to maintain the signals therein in proper relative phase. The symmetric port 522 of central-horn hybrid tee 520 is connected to the sum directional coupler 570 by a waveguide 530.The symmetric port 542 of outer-horns hybrid tee 540 is coupled to the sum directional coupler 570 by waveguide 550. The anti-symmetric port 524 of central horn hybrid tee 520 is coupled to the difference directional coupler 580 by the waveguide 532 and the difference port 544 of outer-horns hybrid tee 540 is coupled to the difference directional coupler 580 by waveguide 552. The lengths of the waveguides 530, 550, 532 and 552 are selected to cause the sum signals of the three horns 100, 200 and 300 to be in phase at aperture 42 and for the difference signals to be in proper relative phase at that aperture.

Difference directional coupler 580 preferably is a top wall or E-plane coupler having a main port 586, a through port 584, a coupled port 582 and an isolated port 588 which is terminated. Main port 586 is the difference port of the comparator. Sum directional coupler 570 preferably is a side wall or H-plane coupler having a main port 576 a through port 572, a coupled port 574 and an isolated port 578 which is terminated. Main port 576 constitutes the sum port of comparator 500. The sum directional coupler 570 has its coupling coefficient adjusted in accordance with the desired sum illumination distribution pattern to be impressed across the three horns, 100, 200 and 300 and is preferably selected in a manner to cause the composite sum signal to be continuous across the face of aperture 42. In this embodiment the coupling is 10.12 dB.

The degree of coupling of difference directional coupler 580 is preferably selected to cause the E-field component of the difference signal to be continuous across the face of aperture 42. In this embodiment the coupling is 4.33 dB.

When the horn is driven via comparator 500, each of the waveguides 132 and 134 propagates a $TE_{10}$ mode. When driven via the sum port 522 only of magic tee 520, these $TE_{10}$ modes are in-phase (i.e. with their electric field vectors parallel) and of equal amplitude. Upon emerging from the waveguide 130 into the larger waveguide 110, these in-phase $TE_{10}$ modes excite both the $TE_{10}$ mode and $LSE_{12}$ mode in waveguide 110 but not the $LSE_{11}$ mode because it is anti-symmetric. Both of these excited modes are symmetric about the central axis of the waveguide 110 and thus constitute sum illumination.

When the horn 100 is driven only at the difference port 524 of magic tee 520, equal amplitude, but 180° out of phase (i.e. with their electric field vectors anti-parallel) $TE_{10}$ modes are excited in and propagated in the waveguides 132 and 134. Upon emerging from waveguide 130 into the enlarged waveguide 110, these anti-parallel $TE_{10}$ modes excite only anti-symmetric modes and of these only the $LSE_{11}$ mode propagates in the waveguide 110. This mode constitutes a difference illumination.

When fed by a $TE_{10}$ mode in the waveguide 230, the waveguide 210 of outer horn 200 is excited with $TE_{10}$ and $LSE_{11}$ modes. The $TE_{10}$ mode is symmetric within the waveguide 210, but the $LSE_{11}$ mode is anti-symmetric within the waveguide 210. However, when the outside horns are fed in-phase with the same amplitude both the $TE_{10}$ and the $LSE_{11}$ modes constitute sum illumination for the horn system 40 because of the orientation of horns 200 and 300 relative to each other (together they are symmetric about center plane 22). When these horns are fed out-of-phase, difference illumination results.

The phases and magnitudes of the transverse E-fields of the various propagating modes within the large waveguide portions 110, 210 and 310 of horns 100, 200 and 300, respectively, and appearing at aperture 42 of feed 30 are illustrated as a function of lateral position within those waveguides (i.e., in the E-plane) in FIGS. 8, 9, and 10 (for excitation at the comparator ports 576 and 586. The propagating modes are $TE_{10}$, $LSE_{12}$ and $LSE_{11}$. The $TE_{10}$ and $LSE_{12}$ modes (FIGS. 8 and 9, respectively) are each laterally symmetric within each waveguide and the $LSE_{11}$ mode (FIG. 10) is laterally anti-symmetric within each waveguide.

The transferse E-field (i.e., across the E-plane) of the $TE_{10}$ mode has the same strength independent of position across the E-plane, (but varies in the H-plane) and is present in each horn. As illustrated in FIG. 8, the magnitude of the $TE_{10}$ mode is preferably greater in the central horn 100 than in the outer horns 200 and 300 to order to achieve the desired near 2:1 ratio between the effective difference aperture and the effective sum aperture.

The $LSE_{12}$ mode is present only in the central horn 100 and has its maximum magnitude at the center line and the side walls 112 and 114 of that horn as illustrated in FIG. 9.

The $LSE_{11}$ mode is present in all three horns and has its maximum magnitude within a horn at the side walls of the horn and a zero magnitude at the center line of each horn as illustrated in FIG. 10.

For a given horn configuration, the ratio of the magnitude of the $TE_{10}$ mode in the outer horn waveguides 210 and 310 to the magnitude of the $TE_{10}$ mode in the central horn waveguide 110 is determined by sum directional coupler 570. The ratio of the magnitude of the $TE_{10}$ mode to the magnitude of the $LSE_{12}$ mode in waveguide 110 is controlled by the horn configuration in the vicinity of end wall 120 of waveguide section 110. The ratio of the magnitude of the combination of these modes ($TE_{10}$ and $LSE_{12}$) to the magnitude of the $LSE_{11}$ mode, all in waveguide section 110, depends on the ratio of the magnitudes of the sum and difference illuminations.

The ratio of the magnitude of the $TE_{10}$ mode to the magnitude of the $LSE_{11}$ mode in the outer horns is determined by the horn structure in the vicinity of the end walls 220 and 320 of the large cross-section waveguide portions 210 and 310, respectively, of these horns. The ratio of the magnitude of the $LSE_{11}$ mode propagating in waveguide 110 of horn 100 to the magnitude of the $LSE_{11}$ mode propagating in waveguides 210 and 310 of horns 200 and 300 is controlled by the difference directional coupler 580.

The transverse E-field sum illumination of feed 30 is illustrated in FIG. 11 as a function of lateral position across the composite aperture 42 of horn system 40. The transverse E-field difference illumination of feed 30 is illustrated in FIG. 12 as a function of lateral position across the aperture 42. The ratio of the sum signal illumination at the point B within waveguide 210 to that at point A within waveguide 210 is determined by the ratio of the magnitude of the $TE_{10}$ and $LSE_{11}$ modes in that waveguide. That ratio is in turn controlled by the internal horn construction. This same ratio exists for the difference illumination in the horn 200. For identical horns 200 and 300, the ratio of the sum magnitudes (and the difference magnitudes) at point F to that at point G in the horn 300 is the same as the ratio of the magnitude at point B to the magnitude at point A in horn 200. In waveguide 110 of horn 100, the sum illumination at points C and E is equal since both of the contributing modes ($TE_{10}$ and $LSE_{12}$) are symmetric. The ratio of the sum magnitude at point D (on the center line) of waveguide 110 to the sum magnitude at point C or E is determined by the internal construction of the horn 100 in the vicinity of the wall 120 since that structure controls the ratio in which the in-phase $TE_{10}$ signals in the sub-waveguides 132 and 134 convert into $TE_{10}$ and $LSE_{12}$ modes in the larger waveguide 110.

The sum signal magnitudes and phases at point B in waveguide 210 and at point C in waveguide 110 are preferably made equal as illustrated in FIG. 8 in order to provide a sum illumination which is continuous across the horn-to-horn transition and which is therefore appropriate for a low side lobe feed pattern. This is accomplished by proper selection of the coupling coefficient of the sum directional coupler 570 (10.12 dB for the illustrated relative signal magnitudes). This adjustment simultaneously affects the relative level of the signal at points B and C and points E and F. Consequently, for a horn system 40 which is symmetric about plane 22, sum signal equality is achieved simultaneously at both points B-C and E-F.

The ratio of the magnitude of the difference illumination at point B in waveguide 210 to the magnitude of the difference illumination at point C in waveguide 110 (and at point E in waveguide 110 and point F in waveguide 310) is controlled by the coupling coefficient of the directional coupler 580 (4.33 dB for the illustrated relative signal magnitudes). Again, for a symmetric horn system equality at the point B-C is obtained for the same coupling coefficient as equality at point E-F is obtained.

Feed 30 has the coupling coefficients of its directional couplers 570 and 580 adjusted as described. Thus, feed 30 provides (1 ) a sum signal whose magnitude and phase is continuous across the horns (that is, one whose magnitude and phase is the same at each of the points B, C, E and F) at the radiating aperture 42 and (2) a difference illumination which has the same magnitude and phase at each of the points B, C, E, and F (again, at aperture 42). Outer horns 200 and 300 have constructions which provide near equal division of the $TE_{10}$ mode in the narrow waveguides 220 and 320 into the $TE_{10}$ and $LSE_{11}$ modes in the large waveguides 210 and 310 with the result that the magnitude of both the sum and difference illuminations is small at points A and G (which are the outer edges of the feed aperture). The combined effect of having an illumination which is without discontinuities across the aperture of the horn and whose magnitude at the extremities of the aperture is near zero is a horn structure radiating a pattern having low side lobes.

The relative magnitude contribution of the outer horns to the sum and difference illuminations is independently controllable by the coupling ratios of the sum and difference directional couplers 570 and 580, respectively.

What constitutes an effective sum aperture width and what constitutes an effective difference aperture width is difficult to define precisely. However, the excitations illustrated in FIGS. 11 and 12 provide what may be considered a two-to-one ratio in the effective difference aperture width to the effective sum aperture width. For applications in which these illuminations are not considered optimum, both the sum and difference illuminations may be changed.

This feed provides freedom to select the shape of the difference illuminations from an infinite set with the desirable features:

1. The illuminations of the center and outer horns can be made to merge with no discontinuity (by relative level selection in the comparator design.)
2. The edge illumination level relative to the peak can be established independently (by choice of $TE_{10}$ and $LSE_{11}$ mode amplitude ratio in the outer horns.)
3. The width and general shape can be controlled (by choice of horn widths and horn width ratios.)

For any of these difference illuminations a variety of sum illuminations is available for which the center horn illumination is completely independent of the difference illumination. Only the illumination ratio of amplitudes at A and B (or G and F) in FIGS. 11 and 12 is common to sum and difference illuminations for the comparator of feed 30. Even this dependence is eliminated by use of an optional feed 600 which is discussed subsequently.

The sum mode illumination can be peaked to lie mostly within the center horn width, or it can be spread to more fully illuminate the outer horns. Available features for the sum illumination include:

1. The illuminations of the center and outer horns can be made to merge with no discontinuity (by relative level selection in the comparator design.)
2. The edge illumination level relative to the peak can be established independently (by choice of inner and outer horn feeding ratios.)

By use of these available design controls the effective width of the sum mode illumination may be established to be very much smaller than the width of the difference mode illumination. Or it may be made any larger size up to one roughly equal to that of the difference illumination. The sum illumination may therefore be selected for the "optimum" ratio of about two-to-one or for another specific value desired for the particular case.

Although feed 30 has been described in terms of its use with an external focusing element, it is also useable by itself in applications where a narrow beam is not required.

Although feed 30 has been pictured as having horn aperture sizes the same as the waveguide cross sections adequate to propagate waves in the various modes, it is also possible to join the individual waveguides 110, 210 and 310 of feed 30 to the small ends of three tapered waveguides paths leading to a composite radiating aperture larger than the radiating aperture 42 of feed 30. The addition of three tapered paths with the larger aperture increases the directivity of the feed. The principle of operation is substantially unchanged. Different waveguide circuit details are used to ensure that proper phase relationships among the various modes are established at the resulting radiating aperture. Taken rigorously, the designations $TE_{10}$, $LSE_{11}$ and $LSE_{12}$ apply to modes in a uniform, that is, non-tapered, waveguide. However, in the tapered part of such a horn, the field distribution in cross-section of the guide is substantially similar to that in a uniform guide provided the taper angle is not too large.

An alternative embodiment of a monopulse feed (30') in accordance with the present invention (FIG. 13) provides independent control over the sum and difference illuminations in the outer horns while providing the same about 2:1 effective aperture width ratio. The horn system 40' of this feed has three horns 100', 200' and 300' which are positioned in the same manner as the horns 100, 200 and 300 of horn system 40 of feed 30 (the horns are spaced apart in FIG. 13 for clarity of the comparator schematic). A comparator 600 in feed 30' in FIG. 13 feeds each of the outer horns 200' and 300' via a hybrid junction which has both a symmetrical and an anti-symmetrical port. The contruction of horns 200' and 300' can be similar to that of horn 100 of feed 30 (FIGS. 1-4) but they are sized to prevent propagation of the $LSE_{12}$ mode. In horns 200' and 300' signals applied to the symmetric port excite the $TE_{10}$ mode in the horn and signals applied to the anti-symmetric port excite the $LSE_{11}$ mode in the horn. The horns 200' and 300' are oriented so that application of two equal amplitude, in-phase signals, one to the $LSE_{11}$ port of each horn, produces $LSE_{11}$ modes in the horns which have even symmetry about the center plane 22' of this horn system 40'. Horn 100' may be identical to horn 100. This feed structure 30' is more complicated than feed structure 30 but provides independent comparator control of the $LSE_{11}$ and the $TE_{10}$ balance in the outside horns 200' and 300'.

Comparator 600 has a sum port 602 and a difference port 604. In FIG. 13 a capital Greek letter sigma (Σ) is used to identify sum or symmetric ports and a capital Greek letter delta (Δ) is used to identify difference or anti-symmetric ports. A pair of directional couplers 612 and 614 separate a signal applied to the sum port 602 into three separate signals. Coupler 612 has its main port connected via a waveguide 680 to sum port 602, its through port connected via a waveguide 682 to the main port of coupler 614, its coupled port connected to a sum port of a hybrid tee 630 and its isolated port terminated. Coupler 614 has its through port connected via waveguide 684 to the symmetrical port of a hybrid tee 620, its coupled port connected to the sum port of a hybrid tee 640 and its isolated port terminated. Coupler 612 provides 11.10 dB of coupling from its main port to its coupled port. Coupler 614 provides 16.68 dB of coupling.

Hybrid tee 630 divides a signal applied to its sum port into two equal amplitude in-phase signals each of which emerges at a different one of the hybrid's two collinear ports. Those signals are then applied through equal length waveguides 686 and 687 to the symmetric ($TE_{10}$) ports of two hybrid tees 660 and 670 without change in relative phase. The hybrid tees 660 and 670 are coupled to the outer horns 200' and 300', respectively. Thus, in-phase $TE_{10}$ modes are excited in outer horns 200' and 300' in response to a signal applied to the sum port of hybrid tee 630.

The hybrid tee 640 divides a signal applied to its sum port into two equal amplitude, in-phase signals each of which emerges from hybrid tee 640 at a different one of its two collinear ports. The signals emerging from the collinear ports of hybrid tee 640 are applied through equal length waveguides 688 and 689 to the asymmetrical ($LSE_{11}$) ports of the hybrid tees 660 and 670 without any change in relative phase. These signals are coupled into the horns 200' and 300' by hybrid tees 660 and 670 and excite $LSE_{11}$ modes which have even symmetry about center plane 22'.

The hybrid tee 620 has its collinear ports connected to the central horn 100' and hybrid tee 620 functions in the same way as hybrid tee 520 of feed 30. Thus, in response to a signal applied to the symmetric port of hybrid tee 620, $TE_{10}$ and $LSE_{12}$ modes are excited in horn 100' which are in phase at composite aperture 42 with the $TE_{10}$ modes in horns 200' and 300' which result from the sum signal applied at port 602. These signals for the stated coupling ratios provide a sum illumination substantially as illustrated in FIG. 11.

A pair of directional couplers 652 and 654 separate a signal applied to the difference port 604 into three signals. Coupler 652 has its main port connected via waveguide 681 to difference port 604, its through port connected via waveguide 683 to the main port of coupler 654, its coupled port connected to the difference port of hybrid tee 630 and its isolated port terminated. Coupler 654 has its through port connected via waveguide 685 to the asymmetrical port of central horn hybrid tee 620, its coupled port connected to the difference port of hybrid tee 640 and its isolated port terminated. Coupler 652 provides a 2.99 dB of coupling from its main port to its coupled port. Coupler 654 provides 5.89 dB of coupling.

Hybrid tee 630 divides a signal applied to its difference port into two equal amplitude, 180° out-of-phase signals each of which emerges at a different one of its collinear ports. These signals are applied through waveguides 686 and 687 to the symmetric ($TE_{10}$) ports of the hybrid tees 660 and 670 without change in relative phase. These signals excite 180° out-of-phase $TE_{10}$ modes in the horns 200' and 300'.

Hybrid tee 640 divides signals applied to its difference port into two equal amplitude, but 180° out-of-phase signals each of which emerges at a different one of its two collinear ports. These signals are applied via waveguides 688 and 689 to the anti-symmetric ($LSE_{11}$) ports of the hybrid tees 660 and 670 without any change in relative phase and thus excite $LSE_{11}$ modes in horns 200' and 300' which have odd symmetry with respect to center plane 22'.

Hybrid tee 620 couples the signal applied to its difference port into horn 100' as an $LSE_{11}$ signal. The signals excited in horns 100', 200' and 300' in response to a signal at the difference port 604 of comparator 600 provide a difference illumination at aperture 42' which is substantially as illustrated in FIG. 12 for the stated coupling ratios.

In order for the sum and difference illuminations of this feed 30' to be the same as those of FIGS. 11 and 12, respectively, the path phase lengths from the sum port 602 and the difference port 604 to the aperture 42' must be selected to establish the phase conditions in FIGS. 11 and 12 among the horns. The proper relationship between the $LSE_{11}$ modes in horns 200' and 300' is established by making waveguide 688 the same length as waveguide 689. Making waveguide 686 the same length as waveguide 687 has the same effect for the $TE_{10}$ modes in horns 200' and 300'. These $TE_{10}$ and $LSE_{11}$ modes are brought into proper phase by selection of the relative lengths of waveguides 686 and 688. The proper relative phases of the $LSE_{11}$ modes in horn 100' and the outer horns is established by selection of the length of waveguide 685. The proper relative phases of the $TE_{10}$ modes in horn 100' and the outer horns is established by the length of waveguide 684. The proper relative phase of the $LSE_{12}$ and the $TE_{10}$ modes in horn 100' is obtained in the same manner as in horn 100 of feed 30.

In feed 30', in accordance with the reciprocal nature of the horns 100', 200' and 300' and the devices employed in the comparator 600, on reception, difference signals are separated from sum signals. The sum signal appears at the sum port 602 of comparator 600 and the difference signal appears at difference port 604 of the comparator 600 in a manner similar to that in feed 30. Thus, the feed 30' when its coupling coefficients are selected for that purpose is functionally equivalent to feed 30. To provide this equivalency the coupler 612 provides 11.10 dB coupling, coupler 614 provides 16.68 dB coupling, coupler 652 provides 2.99 dB coupling and coupler 654 provides 5.89 dB coupling. However, in feed 30' independent control over the magnitude ratio of the $TE_{10}$ mode and the $LSE_{11}$ mode in outer horns 200′ and 300′ is provided by use of hybrid tees 660 and 670 to excite these modes independently. Consequently, when desired, feed 30′ can have its coupling coefficients selected to provide transfer characteristics from its sum and difference ports to its radiation aperture which are different than those provided by feed 30. Some of these characteristics can not be provided by feed 30 without major redesign.

The hybrids 620, 660 and 670 have been described as being separate from but attached to the horns. The function of each of these hybrids can be incorporated directly into its associated horn by use of a horn structure which provides a symmetric port and an anti-symmetric port. In a system of such horns the waveguides 684–689 are connected directly to the corresponding ports of the horns.

In either type of system, each horn has a symmetric port associated with it which excites only symmetric modes within the horn and a anti-symmetric port associated with it which excites only anti-symmetric modes within the horn.

What is claimed is:

1. A radio frequency feed for operation over an operating range of radio frequencies, comprising:

a horn system including first, second and third rectangular horns each dimensioned for supporting the fundamental transverse electric mode and a higher order anti-symmetric mode over said operating range of frequencies, each horn having a radiation aperture, said radiation apertures of said horns positioned to form a composite radiation aperture, said horns being positioned along a line so that the E-fields of said fundamental modes in said horns are aligned collinearly; and means for exciting said first, second and third horns in said fundamental mode and said higher order anti-symmetric mode over said operating range of frequencies, said horns being dimensioned such that said excited modes within said horns provide transverse E-field magnitudes and phases which are substantially continuous across the transitions between the radiation apertures of adjacent horns.

2. The feed recited in claim 1 wherein:

said fundamental mode in each of said horns is the $TE_{10}$ mode; and said higher order anti-symmetric mode in each of said horns is the $LSE_{11}$ mode.

3. The feed recited in claim 2 wherein:

said first horn is between said second and third horns;

said first horn is further dimensioned to support propagation of the higher order symmetric $LSE_{12}$ mode over said operating range of frequencies; and said means for exciting excites said first horn in said $LSE_{12}$ mode over said operating range of frequencies.

4. The feed recited in claim 1 wherein said means for exciting includes:

means for providing sum illumination of said composite radiation aperture responsive to signals applied to a sum port of said feed and for providing difference illumination of said composite radiation aperture responsive to signals applied to a difference port of said feed.

5. The feed recited in claim 4 wherein:

said first horn is a central horn;

said second and third horns are outer horns;

said central first horn is between said outer second and third horns;

said first, second and third horns share a common center plane which is parallel to the plane of polarization and each of said horns is symmetric about said common center plane;

said first horn has a second center plane which is perpendicular to said common center plane;

said horn system being symmetric about said second center plane; and said means for exciting responds to signals applied to said sum port to provide illumination of said composite aperture which is symmetric about said second center plane and responds to signals applied to said difference port to provide illumination of said composite aperture which is anti-symmetric about said second center plane.

6. The feed recited in claim 5 wherein:

said first horn has two ports coupled to said means for exciting and said second and third horns each have one port coupled to said means for exciting.

7. The feed recited in claim 6 wherein said means for exciting includes:

means for separating a signal applied to said sum port into a central horn signal and two outer horn signals;

means for separating a signal applied to said difference port into a central horn signal and two outer horn signals.

8. The feed recited in claim 5 wherein:

said first, second and third horns each have two ports coupled to said means for exciting.

9. The feed recited in claim 8 wherein:

each of said horns has a symmetrical port associated therewith for exciting said fundamental mode in said horn in response to application thereto of a signal in said operating frequency range;

each of said horns has an anti-symmetrical port associated therewith for exciting said higher order anti-symmetrical mode in said horn in response to application thereto of a signal in said operating frequency range;

said means for exciting including:

means for separating a signal applied to said sum port into outer horn fundamental mode signals, two outer horn higher order anti-symmetrical mode signals and a central horn signal; and means for separating a signal applied to said difference port into two outer horn fundamental mode signals, two outer horn higher order anti-symmetrical mode signals and a central horn higher order anti-symmetrical mode signal.

10. The feed recited in claim 9 wherein:

said central horn is further dimensioned to support propagation of a higher order symmetric mode over said operating range of frequencies; and said symmetrical port associated with said central horn also excites said higher order symmetric mode in said central horn in response to a signal applied thereto.

* * * * *